US008939643B2

(12) United States Patent
Goto

(10) Patent No.: US 8,939,643 B2
(45) Date of Patent: Jan. 27, 2015

(54) TETRAHEDRAL SHAPE PACKAGING CONTAINER AND A TETRAHEDRAL SHAPE PACKAGING CONTAINER METHOD

(76) Inventor: Norio Goto, Mito (JP)

( * ) Notice: Subject to any disclaimer, the term of this patent is extended or adjusted under 35 U.S.C. 154(b) by 686 days.

(21) Appl. No.: 13/043,724

(22) Filed: Mar. 9, 2011

(65) Prior Publication Data

US 2011/0315751 A1 Dec. 29, 2011

(30) Foreign Application Priority Data

Jun. 24, 2010 (JP) ..... 2010-158295

(51) Int. Cl.

| | |
|---|---|
| ***B65D 33/00*** | (2006.01) |
| ***B65D 65/26*** | (2006.01) |
| ***B65D 75/58*** | (2006.01) |
| ***B65D 33/25*** | (2006.01) |
| ***B65D 75/50*** | (2006.01) |

(52) U.S. Cl.

CPC ..... *B65D 75/5805* (2013.01); *B65D 33/2508* (2013.01); *B65D 75/50* (2013.01)

USPC ..... 383/204; 383/200; 383/209; 229/87.05

(58) Field of Classification Search

USPC ..... 383/200, 208, 209, 203, 204; 229/87.05, 87.08

See application file for complete search history.

(56) References Cited

U.S. PATENT DOCUMENTS

| | | | | |
|---|---|---|---|---|
| 2,952,394 | A * | 9/1960 | Schneider | 229/113 |
| 3,074,612 | A * | 1/1963 | Schneider | 426/85 |
| 3,404,988 | A * | 10/1968 | Rausing | 426/115 |
| 3,542,190 | A * | 11/1970 | Keller | 426/115 |
| 3,567,074 | A * | 3/1971 | Brown | 222/107 |
| 3,734,388 | A * | 5/1973 | Hopkins | 383/210 |
| 3,791,570 | A * | 2/1974 | Hopkins | 383/210 |

(Continued)

FOREIGN PATENT DOCUMENTS

| | | |
|---|---|---|
| EP | 2 006 208 | 12/2008 |
| EP | 2 103 541 | 9/2009 |

(Continued)

OTHER PUBLICATIONS

Taiwanese Official Action dated Jun. 18, 2013, for TW Application No. 100106705.

(Continued)

*Primary Examiner* — Jes F Pascua
*Assistant Examiner* — Peter Helvey
(74) *Attorney, Agent, or Firm* — Antonelli, Terry, Stout & Kraus, LLP.

(57) ABSTRACT

To provide a tetrahedral shape packaging container or a tetrahedral shape packaging container method in which it prevents stored food from crushing, it maintains the freshness of the stored food or by tear-apart unsealing it can select to use as dish and it can select to reserve left-over food as it is. A tetrahedral shape bag assembly is formed by providing a left side face seam, a right side face seam opposed to the left side face seam, a fastener provided on an upper side and on an inner face of the bag assembly, and an opened lower side face of the bag assembly opposed to the fastener. The opened lower side face of the bag assembly is sealed and a wide width side face seam is formed on the bag assembly in a substantially orthogonal direction to the fastener, thereby it can obtain the tetrahedral shape packaging container having a tetrahedral shape bag assembly. The left side face seam and the right side face seam are tear apart by finger.

12 Claims, 5 Drawing Sheets

(56) References Cited

U.S. PATENT DOCUMENTS

| | | | | |
|---|---|---|---|---|
| 5,188,285 | A * | 2/1993 | Nilsson et al. | 229/242 |
| 6,131,736 | A * | 10/2000 | Farris et al. | 206/440 |
| 7,314,439 | B2 * | 1/2008 | Bossel et al. | 493/189 |
| 8,408,793 | B2 * | 4/2013 | Martuch | 383/207 |
| 2002/0069615 | A1 * | 6/2002 | Gifford et al. | 53/412 |
| 2005/0063617 | A1 * | 3/2005 | Tilman | 383/5 |
| 2006/0034551 | A1 * | 2/2006 | Linneweil | 383/61.2 |
| 2008/0037912 | A1 * | 2/2008 | Martuch | 383/205 |
| 2008/0226207 | A1 * | 9/2008 | Frayne | 383/109 |
| 2012/0273560 | A1 * | 11/2012 | Rupp | 229/87.05 |

FOREIGN PATENT DOCUMENTS

| | | | |
|---|---|---|---|
| WO | WO 2007/119780 | A1 | 10/2007 |
| WO | WO 2008/112112 | | 9/2008 |

OTHER PUBLICATIONS

Extended European Search Report dated Oct. 20, 2011, including the Extended European Search Report and European Search Opinion, for EP Application No. 11250169.7-2308.

* cited by examiner

TETRAHEDRAL SHAPE PACKAGING CONTAINER AND A TETRAHEDRAL SHAPE PACKAGING CONTAINER METHOD

TECHNICAL FIELD

The present invention relates to a tetrahedral shape packaging container (a truss shape solid packaging container) formed by a thin synthetic resin sheet, a synthetic film and a laminated thin paper etc. and a tetrahedral shape packaging container method (a truss shape solid packaging container method).

The present invention relates more particularly to a tetrahedral shape packaging container and a tetrahedral shape packaging container method in which after an unsealing (an opening) of a part of a packaging article or a storing article such as food etc. from a seam or a sealed portion of the packaging container the seam is sealed again, in a state where a remaining article is stored in the packaging container, the remaining article is sealed again by holding a tetrahedral shape-retaining state with an initial stage tetrahedral shape packaging container (an initial stage truss shape solid packaging container).

BACKGROUND TECHNIQUE

In a tetrahedral shape packaging container shown in a conventional technique, in comparison with a flat bag assembly, the tetrahedral shape packaging container having a minimum sheet area and a maximum content volume is obtained, the tetrahedral shape packaging container is used as a milk carton for drinking and a packaging container for storing a morsel size relish etc.

In a former milk carton, an inner face of the milk carton is formed by a laminated hard paper and it is possible to drink milk almost by inserting a straw into an upper opened small hole, however it is impossible to drink by unsealing a part of the milk carton using figure.

In a later packaging container for storing the morsel size relish being sold by a kiosk (register trademark) etc., by tearing apart and unsealing a part of the packaging container formed by a thin synthetic resin sheet, the relish is taken out from an inner portion and it is possible to eat the relish.

The conventional tetrahedral shape packaging container has a feature in which a content volume is the maximum in comparison with that of the flat bag, and further since the packaging container being composed of a truss structure the packaging container has a large strength, and also the packaging container may be crushed hardly against an outside force.

Accordingly, the tetrahedral shape packaging container is suitable to become a packaging container for food etc., which will be damaged by crushing during an overlap custody and during a transportation and further will be failed remarkably a quality of a stored article.

An inventor of the present invention has proposed a tetrahedral shape packaging container in WO 2007/119780 A1. WO 2007/119780 A1 discloses the packaging container having a tetrahedral-shaped bag assembly formed by closing two opposing sides of a pair of film or sheet portions facing each other by using a left side face seam formed between first and second corners of the left side face seam, and a right side face seam formed between first and second corners of the right side face seam, by closing one side of the other two sides of the pair of film or sheet portions facing each other by using a lower side face seam or a lower side face folded portion between the first corner of the left side face seam and the first corner of the right side face seam.

The above tetrahedral shape packaging container is formed closing the other side of the other two sides of the pair of film or sheet portions by an upper side face seam that is substantially orthogonal to the lower side face seam as a result of bringing together and joining the second corner of the left side face seam and the second corner of the right side face seam, and the left side face seam and the right side face seam being constructed as to be respective torn off when used as respective unsealed portions for tearing open the packaging container.

The above tetrahedral shape packaging container composed of a thin sheet is unsealed easily by finger, and in an unsealed state by tearing apart, the packaging container is formed with a dish shape and the packaging container is capable to use as a container (a vessel) as leaving it is.

Since the above tetrahedral shape packaging container can form the dish shape when the packaging container is unsealed as leaving it is, the user can eat a contents without a use of a dinnerware (a tableware) etc. Since it is unnecessary to wash the dinnerware etc, it can save a time and also since it can economize a detergent and a quantity of water, thereby it can correspond easily to an environment.

Further, it is unnecessary to use a foamed polystyrene tray used in the flat bag, and an environment destroy caused by the tray employment and a cost needed for a disposal of a waste matter, in particular it can restrain a discharge of a carbonic acid gas by burning and further it may safety be said that it will be a remarkable technique to improve a transit performance of the packaging container.

SUMMARY OF THE INVENTION

Problems to be Solved

However, in the tetrahedral shape packaging container shown in WO 2007/119780 A1, since it is impossible to seal after the unsealing along to an unseal guide, relating to the remaining stored article it is obliged to preserve it by transferring the remaining stored article into another container etc.

Recently, so as to eat the food by a big family it arrives on the market a large size packaging container, at the same time it causes left-over food. Therefore it is desired to provide a tetrahedral shape packaging container in which it is impossible to store the left-over food by maintaining or holding freshness and a shape of the left-over food.

On the other hand, relating to the preservation of the food material and the food or the reservation of the left-over food using a refrigerator and a freezer, it has proposed a flat bag having a fastener (a zipper) capable to unseal and seal (close) many times through an opened portion and the flat bag is used widely. However, in the flat bag assembly, since it is impossible to form a solid storage space, there is a possibility of crushing the stored food in an inner portion of the flat bag. As a result, in the flat bag assembly having the fastener, it is limited to use the reservation of the food materials and the food etc. having no problem in particularly to be crushed.

The inventor of the present invention aims to solve the above stated problems, and a first object of the present invention is to provide a tetrahedral shape packaging container and a tetrahedral shape packaging container method where after a take-out of a part of a contents by unsealing, and when it sealed again, it is possible to seal by holding again an original state tetrahedral shape and it is possible to prevent the crush of the stored food etc. and it is possible to maintain the freshness.

A second object of the present invention is to provide a tetrahedral shape packaging container and a tetrahedral shape packaging container method where by tearing apart and unsealing it is possible to select to use as a dish leaving it is and it is possible to use to select and to preserve the left-over food taking out in small quantities with a tetrahedral shape package leaving it is.

Problems for Solving Means

The first object according to the present invention is attained by a tetrahedral shape packaging container, in which a tetrahedral shape bag assembly is formed by providing a first side face seam or a first side face folded portion, a second side face seam or a second side face folded portion opposed to the first side face seam or the first side face folded portion, a fastener provided on an upper side and on an inner face of the bag assembly, and an opened lower side face of the bag assembly opposed to the fastener, by sealing the opened lower side face of the bag assembly a third side face seam is formed on the bag assembly in a substantially orthogonal direction to the fastener.

In this time, the improvement of the shape retaining performance of the tetrahedral shape packaging container is attained by sealing the first side face seam and the second side face seam in accordance with the heat-fusion and by heightening the rigidity characteristic.

Further, the first object according to the present invention is attained by a tetrahedral shape packaging container method forming a tetrahedral shape bag assembly formed by providing a first side face seam or a first side face folded portion, a second side face seam or a second side face folded portion opposed to the first side face seam or the first face side folded portion, a fastener provided on an upper side and on an inner face of the bag assembly, and an opened lower side face of the bag assembly opposed to the fastener, and the opened lower side face is sealed in a substantially orthogonal direction to the fastener, and a third side face seam is formed on a lower side of the bag assembly, after a packaging article is inserted into the bag assembly in response to unseal the fastener, thereby the packaging article is packaged in the bag assembly with a tetrahedral shape solid state.

The second object according to the present invention is attained by a tetrahedral shape packaging container, in which a tetrahedral shape bag assembly formed by providing a first side face seam capable of tearing off or a first side face folded portion capable of tearing off, a second side face seam capable of tearing off or a second side face folded portion capable of tearing off opposed to the first side face seam or the first side face folded portion, a fastener provided on an upper side and an inner face of the bag assembly, and an opened lower side face of the bag assembly opposed to the fastener, by sealing the lower side a third side face seam is formed on a lower side of the bag assembly in a substantially orthogonal direction to the fastener.

Further, the second object according to the present invention is attained by a tetrahedral shape packaging container method forming a tetrahedral shape bag assembly formed by providing a first side face seam capable of tearing off or a first side face folded portion capable of tearing off, a second side face seam capable of tearing off or a second side face folded portion capable of tearing off opposed to the first side face seam or the first side face folded portion, a fastener provided an upper side and an inner face of the bag assembly, and an opened lower side face of the bag assembly opposed to the fastener, the opened lower side face is sealed in a substantially orthogonal direction to the fastener and a third side face seam is formed on a lower end of the bag assembly, after a packaging article is inserted into the bag assembly in response to unseal the fastener, thereby the packaging article is packaged in the bag assembly with a tetrahedral shape solid state.

Effects of the Invention

A first effect obtained by the present invention, it can provide a tetrahedral shape packaging container and a tetrahedral shape packaging container method in which after a part of a packaging article of a bag assembly by unsealing or opening) of the packaging container, when the packaging container is sealed or closed again, it is possible to hold easily an initial stage tetrahedral solid shape and to seal, it is possible to prevent from crushing a stored food etc. and to hold freshness of the stored food etc.

A second effect obtained by the present invention, it is can provide a tetrahedral shape packaging container and a tetrahedral shape packaging container method in which by unsealing the packaging container to tear apart, it is possible to select to use the packaging container as a dish, it is possible to take out in small quantities, and it is possible to select and to use and to reserve left-over food as leaving it is with a tetrahedral solid shape package.

EMBODIMENT FOR CARRYING OUT THE INVENTION

Hereinafter, a constitution, a manufacturing process and a manufacturing method of a tetrahedral shape packaging container of one embodiment according to the present invention will be explained in detail.

The tetrahedral shape packaging container of one embodiment according to the present invention is constituted from a flat bag assembly as a bag assembly. First of all, one example of a manufacturing process of the flat bag assembly will be explained according to FIG. 1, FIG. 2 and FIG. 3.

Figure 1:
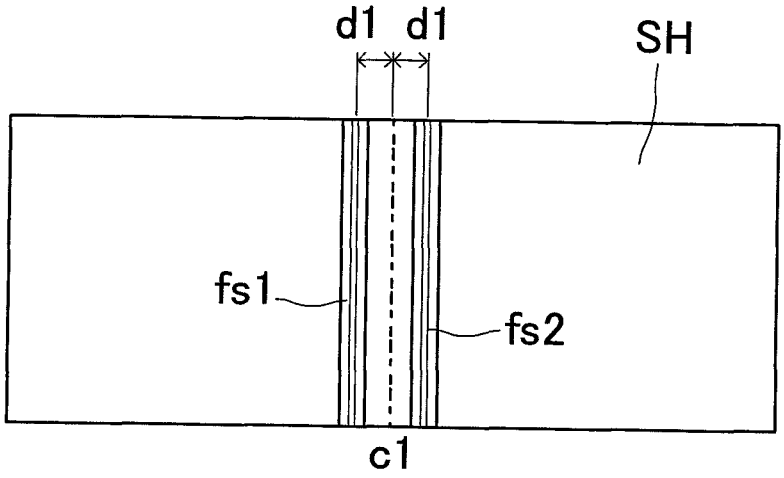
FIG. 1 is a plane view of a sheet having a fastener for manufacturing a flat bag assembly for constituting a tetrahedral shape packaging container of one embodiment according to the present invention.

FIG. 1 is a plane view of a sheet having a fastener for manufacturing a flat bag assembly constituting a tetrahedral shape packaging container of one embodiment according to the present invention. In FIG. 1, a sheet SH is made of a transparent material, a semi-transparent material or a non-transparent material etc. The sheet SH has a longitudinal direction size of 60 cm, a lateral direction size of 25 cm and a thickness of 30-50 μm. The sheet SH is made of a thin synthetic resin etc. including a polypropylene, polyethylene terephthalate, etc. which are materials to gentle against nature. The sheet SH can be cut off suitably with an appropriate size a sheet in which formed by vinyl chloride etc. or wound in a roll shape etc. Further, the sheet SH can be formed of a laminated sheet, a laminated film and a paper sheet etc.

In a manufacturing process of the flat bag assembly shown in FIG. 1, the sheet SH has a rail shape fastener fs at an inner portion. The fastener fs comprises a re-entrant string member fs1 and a strip string member fs2. The sheet SH has a longitudinal direction center line c1. At a position separating with a distance d1 in a left direction from the center line c1 of the sheet SH, the re-entrant string member fs1 of the fastener fs is heat-sealed to the sheet SH.

Similarly to, at a position separating with a distance d1 in a right direction from the center line c1, the strip string member fs2 of the fastener fs is heat-sealed to the sheet SH. The strip string member fs2 is inserted into or removed out from the re-entrant string member fs1. The strip string member fs2 is performed to unseal or seal the fastener fs. A length of the fastener fs has a substantial same length of a width of the sheet SH or has a little short length of the sheet SH.

Figure 2:
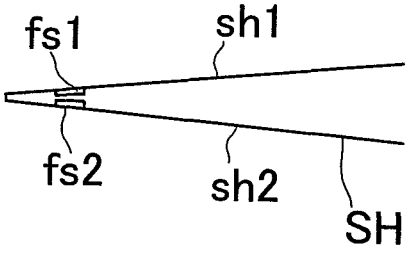
FIG. 2 is a fold back view of the sheet having the fastener for manufacturing the flat bag assembly.

FIG. 2 is a fold back view of the sheet having the fastener for manufacturing the flat bag assembly. The sheet SH is turned up and folded up at the center line c1. The sheet SH comprises an upper side (a front side) sheet sh1 and a lower side (a back side) sheet sh2 at both sides of the center line c1 of the sheet SH.

Figure 3:
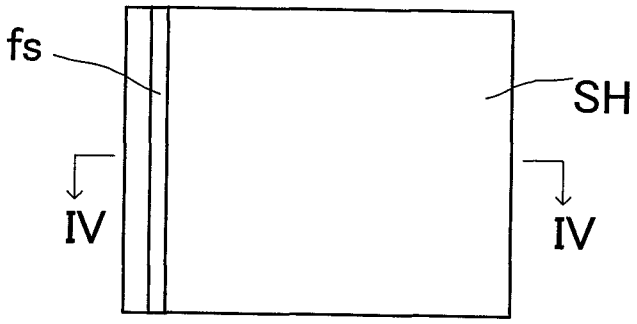
FIG. 3 is a complete fold back view of the sheet having the fastener for manufacturing the flat bag assembly.

FIG. 3 is a complete fold back view of the sheet having the fastener for manufacturing the flat bag assembly. In FIG. 3, after the sheet SH has turned up and folded up, by applying the pressure from an upper portion of the turned-up sheet SH, the strip string member fs2 is pushed into and inserted into the re-entrant string member fs1.

Figure 4:
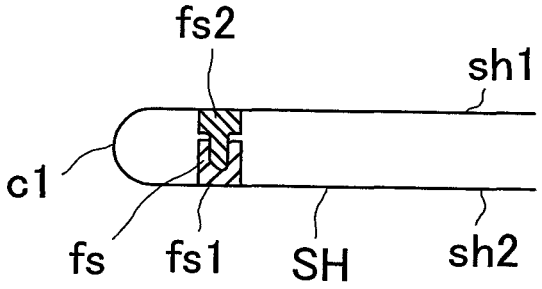
FIG. 4 is a cross-sectional view of the fastener of the sheet for manufacturing the flat bag assembly along to a line IV-IV of FIG. 3.

FIG. 4 is a cross-sectional view of the fastener of the sheet for manufacturing the flat bag assembly. In FIG. 4, the strip string member fs2 is pushed into and inserted into the re-entrant string member fs1 and the fastener fs is sealed and the fastener fs is fixed according to a heat-fusion manner to the sheet SH. In FIG. 4, the fastener fs is sealed by applying the force by finger and the fastener fs is unsealed by pulling out by finger. The fastener fs is closed by applying force by finger and is opened by pulling out.

Figure 5:
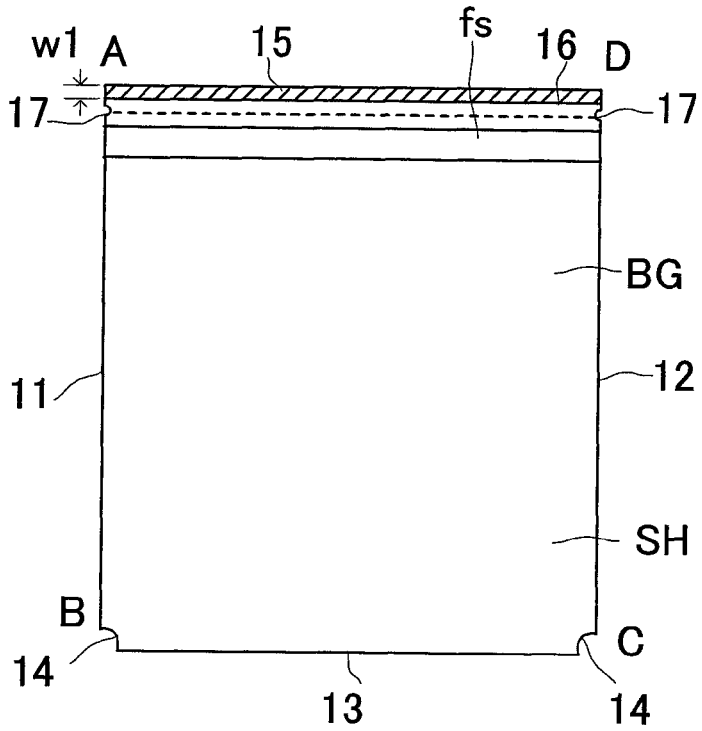
FIG. 5 is a plane view of the flat bag assembly which is served as a tetrahedral shape packaging container of one embodiment according to the present invention.

FIG. 5 is a plane view of the flat bag assembly which is served as a tetrahedral shape packaging container of one embodiment according to the present invention. During the heat-fusion operation, by an electromagnetic induction heating for applying to the sheet SH and the fastener fs and a time of an ultrasonic heating energy and by adjusting a width of a heat-fusion portion, it is possible to tear apart by making the heat-fusion portion weak or it is possible to tear apart hardly by making the heat-fusion portion strong, therefore it can select according to the demand for the use conditions.

In FIG. 5, the flat bag assembly BG comprises a left side face seam (a first side face seam) or a left side face sealed portion (a first side face sealed portion) 11 and a right side face seam (a second side face seam) or a right side face sealed portion (a second side face sealed portion) 12. The left side face seam 11 is indicated by a side A-B. The right side face seam 12 is an opposite side of the left side face seam 11 and is indicated by a side C-D. It is possible to form respectively the left side face seam 11 and the right side face seam 12 as folded portions (a first side face portion and a second side face folded face) of the flat bag assembly.

Each of the left side face seam 11 and the right side face seam 12 is formed by a weak heat-fusion manner when each of the left side face seam 11 and the right side face seam 12 is aimed to unseal by tearing apart. However, each of the left side face seam 11 and the right side face seam 12 is formed by a strong heat-fusion manner when each of the left side face seam 11 and the right side face seam 12 is aimed to not tear apart.

The left side face seam 11 and the right side face seam 12 are heat-sealed according to the ultrasonic and the electromagnetic induction wave and in addition to the above it is possible to seal by a hot wire manner which is represented by a Nichrome wire.

The left side face seam 11 and the right side face seam 12 are formed with a bar shape (a line shape, a strap shape) by making thin extremely partially than a row material sheet. Further, the left side face seam 11 and the right side face seam 12 may be substituted by a sheet which has a direction characteristic capable to tear apart the sheet along to the seam of a sheet row material.

The left side face seam 11 and the right side face seam 12 have the satisfactory airtight characteristic. However, so as to unseal easily and surely, seal strength of each of the left side face seam 11 and the right side face seam 12 is made weak to have the strength by tearing apart by finger. Since a seal width of each of the left side face seam 11 and the right side face seam 12 is formed of 0.2 mm degree or less than 0.2 mm, it is possible to obtain the left side face seam 11 and the right side face seam 12 having tearing apart easily even by child.

The flat bag assembly BG comprises a lower side face 13 having an opened portion (an opening) indicated by a side B-C. The flat bag assembly BG comprises two tear-apart guides 14 by cutting off two corner portions with a fan shape, the two tear-apart guides 14 formed between the left side face seam 11 and the right side face seam 12 of the flat bag assembly BG.

The flat bag assembly BG comprises an upper side face folded portion (an upper portion sealed portion) 15 indicated by a side A-D, this upper side face folded portion 15 forms a completed sealed portion by turning up at the center line c1 of the sheet itself. The upper side face folded portion 16 corresponds to the center line c1 which is turned up in FIG. 4.

Further, apart from the upper side face folded portion 15, as an upper portion being opened, by heat-fusing the face side sheet sh1 and the back side sheet sh2 of the sheet SH with a predetermined width w1 and an upper portion side face seam (a fourth side face seam) or an upper portion side face sealed portion (a fourth side face sealed portion) 16 is formed, thereby it is possible to seal closely using the upper portion side face seam 16. The upper portion side face seam16 is provided at the upper portion from the fastener fs and heightens surely the airtight characteristics.

The fastener fs is provided in the inner portion of the flat bag assembly BG by separating from the upper side face folded portion 15 with a predetermined distance. This fastener fs is the similar one, which is called as an airtight package. The airtight package can store the food in the refrigerator or the freezer and is used to form an opening portion of the airtight package.

Regardless of a closed state and an opened state of the fastener fs, the fastener fs has a function for restoring to an original state at a linear state according to an elastic force being possessed itself. The flat bag assembly BG is completed as shown in FIG. 5. The flat bag assembly BG is an airtight flat bag assembly BG in accordance with the sealed fastener fs and the two side heat-fusion constitutions of the left side face seam 11 and the right side face seam 12.

To the upper portion of the flat bag assembly BG, since the upper side face folded portion 15 is provided at the fastener fs and a chip end edge thereof, even the sealing characteristic of the fastener fs may be damaged slightly, it is possible to seal surely the upper side face folded portion 15 formed by the fold-back portion of the sheet SH. As a result, it is possible to seal surely the packaging article in the flat bag assembly BG, in specially a liquid article and it does not leak to an outside portion.

The flat bag assembly BG comprises two triangle shape cut-off portions 17 which are provided between the upper side face folded portion 16 and the fastener fs at the left side face seam 11 and the right side face seam 12. By tearing apart the upper portion of the flat bag assembly BG from the cut-off portion 17 toward an upper lateral direction, it can separate the upper side face folded portion 15 and the upper side face folded portion 16 from the flat bag assembly BG. The flat bag assembly BG comprises a linear shape tear-apart portion 20 between the two cut-off portions 17 and the tear-apart portion 20 comprises many perforations to tear apart or to separate the upper side face folded portion 16 form the bag assembly BG.

The cut-off portion 17 may provide according to a method for cutting off merely using a scissors or according to a method for cutting off in a triangle shape as shown in FIG. 5. It is possible to provide only a single cut off portion 17. It will be unnecessary to constitute the flat bag assembly BG by employing a sheet which has the tear-apart characteristic in a lateral direction, however it is necessary to provide a mark showing a tear-apart portion such as an arrow mark.

The flat bag assembly BG has a longitudinal direction size of 30 cm and a lateral direction size of 25 cm. The flat bag assembly BG transforms to a tetrahedral shape bag assembly. The flat bag assembly BG is formed for a tetrahedral shape packaging container having a large capacity in which it is supposed that it will eat the food etc. by taking out in small quantities and the remaining food will be stored using the tetrahedral shape packaging container PC.

Next, hereinafter a procedure and a method for forming the tetrahedral shape packaging container PC using the flat bag assembly BG shown in FIG. 5 will be explained according to FIG. 6 and FIG. 7.

Figure 6:
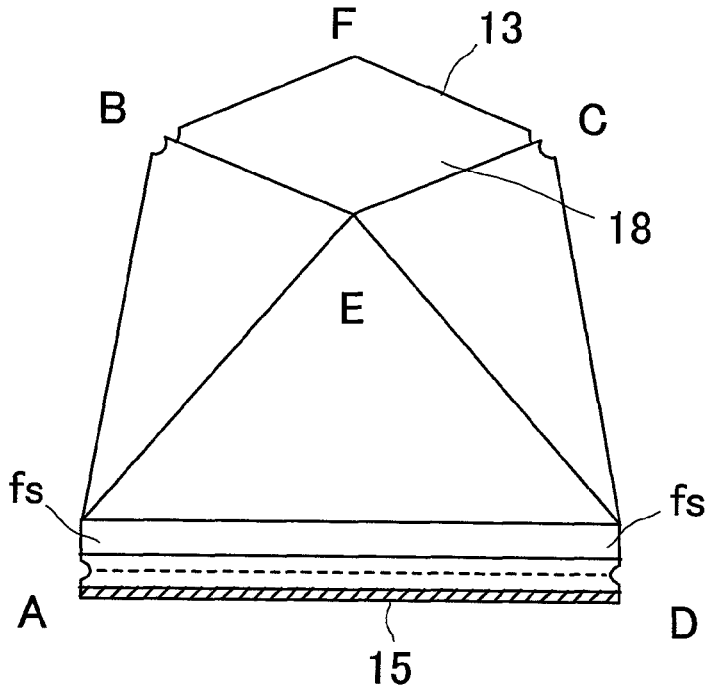
FIG. 6 is an oblique view of the tetrahedral shape packaging container which is constituted by reversing the bag assembly shown in FIG. 5.

FIG. 6 is an oblique view the tetrahedral shape packaging container by reversing the flat bag assembly BG. In FIG. 6, the fastener fs is closed surely and the fastener fs is positioned at a lower portion. Therefore, in this state, the upper side face folded portion 15 is positioned in the lower portion, the lower side face 13 becomes to form an upper opened portion 18.

In this state, the upper opened portion 18 is spread largely as shown in FIG. 6, a packaging article such as vegetable such as the baby leaf, and the boiled rice such as the red boiled rice and the pilaf, the food such as the relish and other articles can be stored. As to the packaging article, there is a small article such as a component article, for example a plastic model and a screw component article etc., any kind of the article will be stored in the flat bag assembly BG.

When the vegetable etc. are thrown into the tetrahedral shape packaging container PC from the upper opened portion 18, since the air flows into together and is sealed, further since the tetrahedral shape of the tetrahedral shape packaging container PC is maintained, the contents is not crushed, the tetrahedral shape packaging container PC is suitable for the package of a strawberry, a cherry and a vegetable or other articles.

In FIG. 6, after the packaging article has stored from the upper opened portion 18 into the bag assembly BG, the left corner portion B provided on the tear-apart guide 14 are aligned together and is joined together with the right corner portion C provided on the tear-apart guide 14. The corner B portion of the opened lower side face 13 is aligned together and is joined with the corner C portion opposed the corner B portion of the opened lower side face 13. A middle point E portion of the opened lower side face 13 is aligned together and is joined together with a middle point F portion opposed to the middle point E portion of the opened lower side face 13.

The opened lower side face 13 is sealed by a predetermined wide width side face seam (a third side face seam) or a predetermined wide width side face sealed portion (a third side face sealed portion) 19. The wide width side seam 19 is formed on the bag assembly BG in the substantially orthogonal direction to the fastener fs. As a result, it can obtain the tetrahedral shape packaging container PC having a truss shape solid constitution.

The left corner B of the opened lower side face 13 and the right corner C of the opened lower side face 13 are brought together and are joined and further the face side middle portion E of the opened lower side face 13 and the back side middle F of the opened lower side face 13 are brought together and are joined. The opened lower side face 13 becomes to the low side face having no opened portion. The low side face having no opened portion is sealed with the wide width side face seam (the third side face seam) 19.

A sealing width of the wide width side face seam 19 is 10 mm degree and the wide width side face seam 19 is sealed surely and it has strength difficult to unseal to open by finger from a part of the wide width side face seam 19. The wide width side seam 19 maintains the tetrahedral shape performance of the bag assembly BG. The heat-sealing manner for the wide width side face seam 19 is adopted selectively from the various kind manners.

Figure 7:
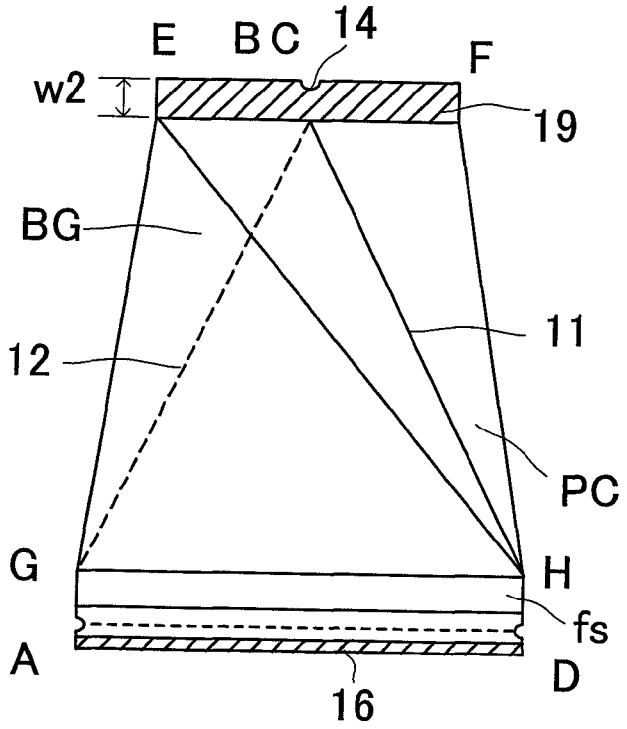
FIG. 7 is an oblique view of the tetrahedral shape packaging container in which the fastener of the bag assembly is positioned at a lower portion.

FIG. 7 is an explanation view of the tetrahedral shape packaging container in which the fastener of the flat bag assembly is positioned at a lower portion. In FIG. 7, the tetrahedral shape packaging container PC having all of four faces including four corners, which are corner E, corner F, corner G and corner F, in a truss shape structure can be obtained. The bag assembly BG of the tetrahedral shape packaging container PC has the wide width side face seam 19 and the wide width side face seam 19 is formed similarly according to the heat-fusion manner etc. In this tetrahedral shape packaging container PC, the wide width side seam 19 becomes to the orthogonal state against the fastener fs of the bag assembly BG.

During the sealing time of the bag assembly BG, the carbonic acid gas etc. is enclosed, it is possible to maintain the freshness of the vegetable at the long time and it can apply easily to the articles required to the transportation several days. It can vary the kind of the gas to be enclosed in accordance with the storing article.

Figure 8:
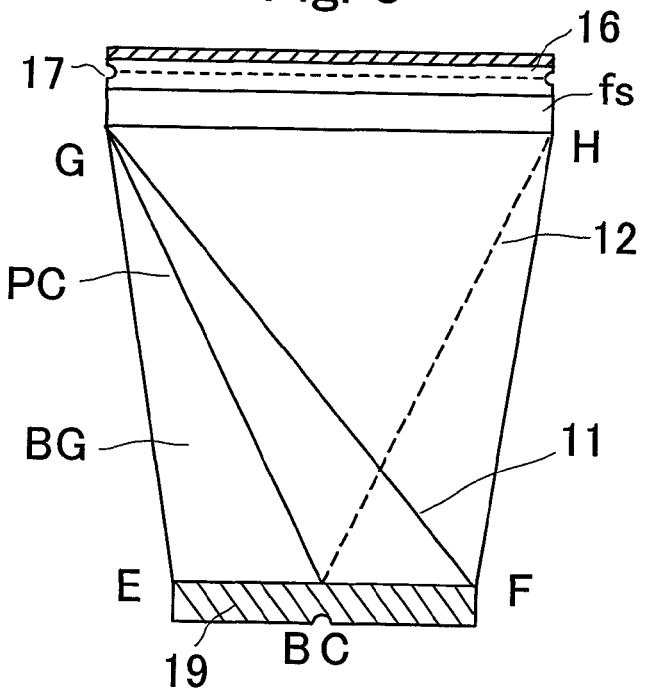
FIG. 8 is an oblique view of the tetrahedral shape packaging container in which the fastener of the bag assembly is positioned at an upper portion.

FIG. 8 is an oblique view of the tetrahedral shape packaging container in which the fastener of the bag assembly is positioned at an upper portion. The tetrahedral shape packaging container PC has a tetrahedral shape and constitutes a truss shape solid packaging container. The tetrahedral shape packaging container PC has the tetrahedral shape bag assembly BG comprised of the fastener fs in the portion, the left side face seam (the first side face seam) 11, the right side face seam 12 (the second side face seam), the wide width seam (the third side face seam) 19, and the upper side face seam (the fourth side face seam) 16. The wide width side face seam 19 is formed in the substantially orthogonal direction of the fastener fs.

Figure 9:
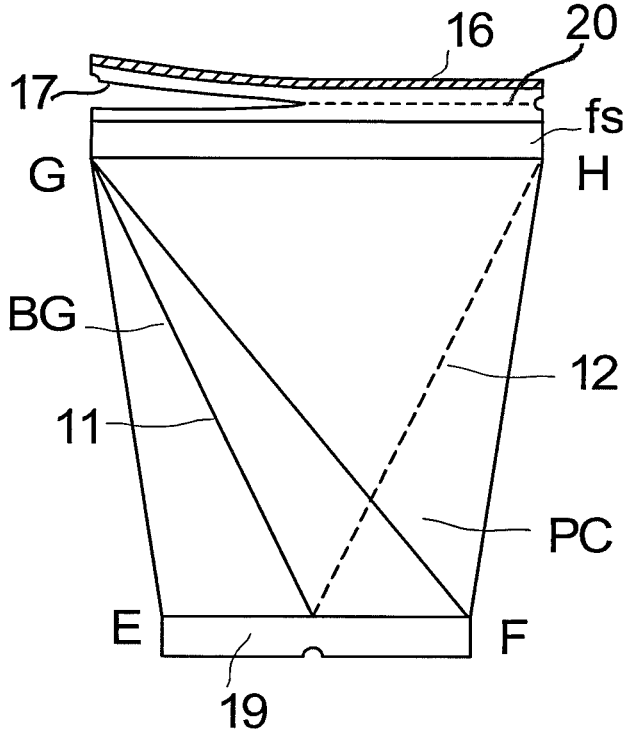
FIG. 9 is an explanation view of the tetrahedral shape packaging container in which an end of an upper portion of the fastener of the bag assembly is tear apart.

Next, it will be explain about the unsealing of the tetrahedral shape packaging container PC stored the food etc. and about the eating of the food etc. FIG. 9 is an explanation view of the tetrahedral shape packaging container in which an end of an upper portion of the fastener fs is tear apart along the perforations of the tear-apart guide 20 form the cut-off portion 17 so as to unseal the fastener fs.

First of all, when it eats ordinary, by opening the fastener fs it can take out the stored food etc. with the desired amount from the tetrahedral shape packaging container PC and it can eat the taken-out food. When the food etc. is remained, by closing the fastener fs again and it is possible to reserve the tetrahedral shape packaging container PC in the refrigerator etc.

Since the fastener fs is formed with comparative hard quality and with a linear shape, to unseal even it is bent by an outside force, it can open the outside force, it can function to restore the stored articles an original shape state. A restoring force is similarly to it during the unsealing time, and the fastener fs functions always to hold to be a right angle against the lower side face 13.

Namely, a case where the comparative high synthetic fastener fs is provided to the sheet SH, it is possible to hold automatically the fastener fs with a shape-retain state. When the tetrahedral shape packaging container PC is sealed again, the air flows into naturally the tetrahedral shape packaging container PC and with the filled-up air state, it is possible to perform the tetrahedral solid shape.

Further, at this time, the left side face seam 11 and the right side face seam 12 having the high rigidity characteristics performs the reinforcement ribs (supports) for holding the tetrahedral solid shape and it can prevent from the getting out the shape of the tetrahedral solid shape. Accordingly, during the unsealing and sealing the fastener fs, by cooperating the fastener fs, the left side face seam 11 and the right side face seam 12, it is possible to hold the tetrahedral shape packaging container PC with the tetrahedral solid shape.

In other words, at the time of the re-seal of the tetrahedral shape packaging container PC, since it is possible to hold naturally the tetrahedral solid packaging container PC as the tetrahedral solid shape, the air is unnecessary newly to blow into the tetrahedral shape packaging container PC, it is possible to carry out simply the tetrahedral shape packaging container PC in the tetrahedral solid shape.

As a result, it is possible to reappear the tetrahedral shape packaging container PC in which after the eating the air is filled up fully, and since it is possible to hold the shape of the tetrahedral shape packaging container PC, it does not crush the foods such as the baby leaf and other articles and it is possible to hold the freshness and to hold them. This is the effect in which it can not attain by the conventional flat bag assembly. The above statements are as a main the concrete constitution for attaining the first effect of the present invention.

Next, it will be explain about the embodiment for attaining the second effect of the present invention according to the above stated constitution. When it eats all of the stored food at one time, it is possible to tear apart the left side face seam 11 and the right side face seam 12 and it is possible to unseal along to the left side face seam 11 and the right side face seam 12 from the tear-apart guide 14 (corner B and corner C). In this time, the left side face seam 11 and the right side face seam 12 are positioned at corner G and corner H, which are the heat-fused portions of the fastener fs.

In FIG. 7, the left side face seam 11 and the right side face seam 12 are tear apart. The tetrahedral shape packaging container PC transforms the dish shape. Namely, it is possible to use the tetrahedral shape packaging container PC as the tableware.

After the eating, since this tetrahedral shape packaging container PC itself functions as the tableware or the dish, it is unnecessary to prepare separately the tableware for eating etc. On the other hand, in the conventional tetrahedral shape packaging container shown in WO 2007/119780 A1, when the packaging container is tear apart and unsealed once, since this packaging container does not seal again, the remaining food etc. does necessary to throw or to reserve by transferring it to another vessel. Accordingly, this is wasting and at the same time this is troublesome.

Figure 10:
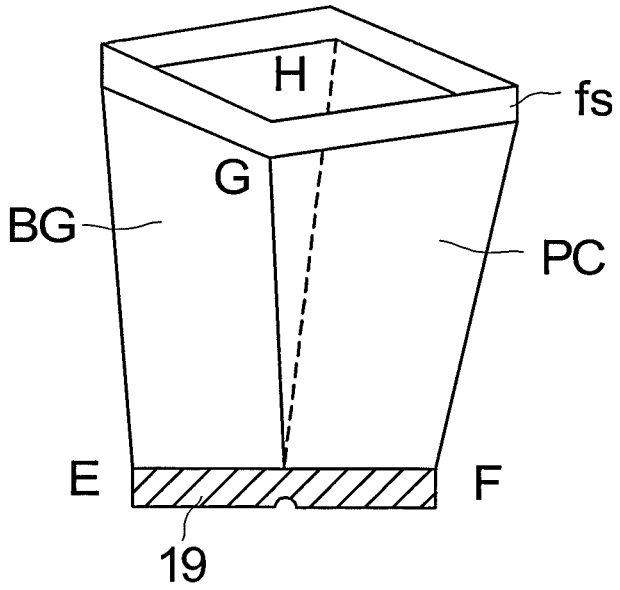
FIG. 10 is an explanation view of the tetrahedral shape packaging container in which the fastener of the bag assembly is unsealed.

FIG. 10 is an explanation view of the trihedral shape packaging container in which the fastener of the bag assembly is unsealed. According to the present invention, when the user wishes to eat by dividing several times, by overturning the tetrahedral shape packaging container PC, the fastener fs is practiced to bring at the upper portion. Further, as shown in FIG. 9, the upper side face folded portion 15 and the upper portion side face seam 16 are separated by tearing apart in the lateral direction from the cut-into portion 17 and then the fastener fs is looked out upon.

With this state, where the upper side folded portion 15 and the upper portion side face seam are separated, of the tetrahedral shape packaging container PC according to the present invention, in which the fastener fs is looked out upon, the fastener fs is unsealed as shown in FIG. 10, it is possible to take out the necessary quantity food etc. through the fastener fs and to eat the food etc. The remaining food is sealed by sealing again the fastener fs and is reserved to the refrigerator etc.

According to the present invention, in the tetrahedral shape packaging container PC it is possible to select the unsealing methods according to the demand, especially it is effective to obtain the large capacity tetrahedral shape packaging container PC having the function of the tableware during the unseal time.

The invention claimed is:

1. A tetrahedral shape packaging container, comprising a tetrahedral shape bag assembly made of a resin film or resin sheet, said bag assembly having a first side face seam or a first side face folded portion; a second side face seam or a second side face folded portion opposed to said first side face seam or said first side face folded portion; a fourth side face seam or a fourth side face folded portion at an upper side of said bag assembly; a fastener provided below said fourth side face seam or said fourth side face folded portion and spaced therefrom, and on an inner face, of said bag assembly; and a third side face seam of said bag assembly, provided in a substantially orthogonal direction to a direction that said fastener extends, at an opposite end of the bag assembly to an upper side on which said fastener is provided, said third side face seam being formed from an opened lower side face of said bag assembly opposed to said fastener and said fourth side face seam or said fourth side face folded portion, said opened lower side face being a location at which an article to be packaged in said packaging container is inserted into said packaging container, with said opened lower side face being sealed after inserting said article to be packaged, so as to form said third side face seam, said article to be packaged being inserted in a state where said upper side of the bag assembly is sealed, whereby, when said third side face seam has been formed and said fastener sealed, said bag assembly is maintained with a tetrahedral solid shape in a state where said article has been inserted, and wherein said bag assembly is adapted to be torn apart between said fourth side face seam or said fourth side face folded portion and said fastener so as to take said article out of said bag assembly.

2. A tetrahedral shape packaging container according to claim 1, wherein a resin of said resin film or said resin sheet is selected from the group consisting of polypropylene, polyethylene terephthalate and vinyl chloride.

3. A tetrahedral shape packaging container according to claim 1, wherein said bag assembly has an upper side face folded portion adjacent said upper side on which said fastener is provided, said upper side face folded portion having been formed by folding said resin film or said resin sheet, said fourth side face folded portion being opposite to said third side face seam.

4. A tetrahedral shape packaging container according to claim 1, wherein an end of said bag assembly, opposite to the end provided by said third side face seam, and adjacent to said fastener, is a sealed end, capable of being removed so as to expose said fastener.

5. A tetrahedral shape packaging container according to claim 1, wherein said resin film or said resin sheet is a single resin film or a single resin sheet, having a fourth side face folded portion.

6. A tetrahedral shape packaging container according to claim 1, wherein said article to be packaged is inserted in a state where the fastener is sealed.

7. A tetrahedral shape packaging container according to claim 1, characterized in that by aligning one corner portion of said opened lower side face with another corner portion opposed to said one corner portion of said opened lower side face, by aligning one middle point portion of said opened lower side face with another middle point portion opposed to said one middle point portion of said opened lower side face, and by sealing said opened lower side face to form said third side face seam, by sealing the aligned portions, said third side face seam is formed on said bag assembly in said substantially orthogonal direction to said fastener.

8. A tetrahedral shape packaging container according to claim 1, characterized in that said first side face seam and said second side face seam are sealed respectively by heat fusion.

9. A tetrahedral shape packaging container method, comprising:

forming a tetrahedral shape bag assembly made of a resin film or a resin sheet, said bag assembly being formed by providing a first side face seam or a first side face folded portion, a second side face seam or a second side face folded portion opposed to said first side face seam or said first face side folded portion, and a fourth side face seam or a fourth side face folded portion at an upper side of said bag assembly, said bag assembly having an opened lower side face which is a location at which an article to be packaged in said packaging container is inserted into said packaging container;

forming a fastener below said fourth side face seam or said fourth side face folded portion and spaced therefrom, and on an inner face, of said bag assembly, said opened lower side face being at an opposite end of said bag assembly to an upper side of the bag assembly on which said fastener is provided;

inserting said article to be packaged in said packaging container, into said bag assembly, through said opened lower side face, in a state in which said fastener is sealed;

sealing said opened lower side face, to form a third side face seam, said opened lower side face being sealed in a substantially orthogonal direction to that in which said fastener extends, whereby when said article is packaged in said packaging container said bag assembly is maintained with a tetrahedral solid shape; and tearing apart said tetrahedral solid shape bag assembly between said fourth side face seam or said fourth side face folded portion and said fastener so as to take out said article.

10. A tetrahedral shape packaging container method according to claim 9, wherein said resin film or said resin sheet is a single resin film or a single resin sheet, and said bag assembly is formed by providing a fourth side face folded portion.

11. A tetrahedral shape packaging container method according to claim 9, characterized in that by aligning one corner portion of said opened lower side face with another corner portion opposed to said one corner portion of said opened lower side face, by aligning one middle point portion of said opened lower side face with another middle point portion opposed to said one middle point portion of said opened lower side face, and by sealing said opened lower side face to form said third side face seam, by sealing the aligned portions, said third side face seam is formed on said bag assembly in said substantially orthogonal direction to said fastener.

12. A tetrahedral shape packaging container method according to claim 9, characterized in that said first side face seam and said second side face seam are sealed respectively by heat fusion.

* * * * *